US010418710B2

(12) United States Patent
Lindenmeier et al.

(10) Patent No.: US 10,418,710 B2
(45) Date of Patent: Sep. 17, 2019

(54) ANTENNA FOR THE RECEPTION OF CIRCULARLY POLARIZED SATELLITE RADIO SIGNALS FOR SATELLITE NAVIGATION ON A VEHICLE

(71) Applicant: FUBA Automotive Electronics GmbH, Bad Salzdetfurth (DE)

(72) Inventors: Stefan Lindenmeier, Gauting-Buchendorf (DE); Heinz Lindenmeier, Planegg (DE)

(73) Assignee: FUBA Automotive Electronics GmbH (DE)

( * ) Notice: Subject to any disclaimer, the term of this patent is extended or adjusted under 35 U.S.C. 154(b) by 0 days.

(21) Appl. No.: 15/937,034

(22) Filed: Mar. 27, 2018

(65) Prior Publication Data

US 2018/0294571 A1 Oct. 11, 2018

(30) Foreign Application Priority Data

Mar. 30, 2017 (DE) ..... 10 2017 003 072

(51) Int. Cl.

| | |
|---|---|
| ***H01Q 9/04*** | (2006.01) |
| ***H01Q 1/32*** | (2006.01) |
| ***H01Q 7/00*** | (2006.01) |
| ***H01Q 1/24*** | (2006.01) |
| ***H01Q 9/26*** | (2006.01) |
| *H01Q 1/38* | (2006.01) |

(52) U.S. Cl.

CPC ..... *H01Q 9/0428* (2013.01); *H01Q 1/241* (2013.01); *H01Q 1/3275* (2013.01); *H01Q 7/00* (2013.01); *H01Q 9/265* (2013.01); *H01Q 1/38* (2013.01)

(58) Field of Classification Search

CPC .... H01Q 1/24; H01Q 7/00; H01Q 9/04–0428; H01Q 9/265

See application file for complete search history.

(56) References Cited

U.S. PATENT DOCUMENTS

| | | | |
|---|---|---|---|
| 2011/0215978 A1 | 9/2011 | Lindenmeier et al. | |
| 2012/0050120 A1 | 3/2012 | Lindenmeier et al. | |
| 2014/0028512 A1* | 1/2014 | Lindenmeier ..... | H01Q 7/00 343/741 |

(Continued)

FOREIGN PATENT DOCUMENTS

| | | |
|---|---|---|
| DE | 4008505 A1 | 9/1991 |
| EP | 2296227 A2 | 3/2011 |

(Continued)

OTHER PUBLICATIONS

European Search Report for European Application No. 18163139.1 dated Aug. 6, 2018; 4 pages.

*Primary Examiner* — Dameon E Levi
*Assistant Examiner* — Hasan Z Islam

(57) ABSTRACT

An antenna for the reception of circularly polarized satellite radio signals comprises a conductor loop that is arranged above a conductive base surface and that is configured as a ring line radiator that forms a resonant structure. Vertical radiators extending toward the conductive base surface are present at the periphery of the ring line radiator, with the excitation of the conductor loop taking place via one of the radiators as an active radiator. A specific number of passive vertical radiators galvanically coupled to the ring line radiator is furthermore provided.

15 Claims, 10 Drawing Sheets

(56) References Cited

U.S. PATENT DOCUMENTS

Figure 1:
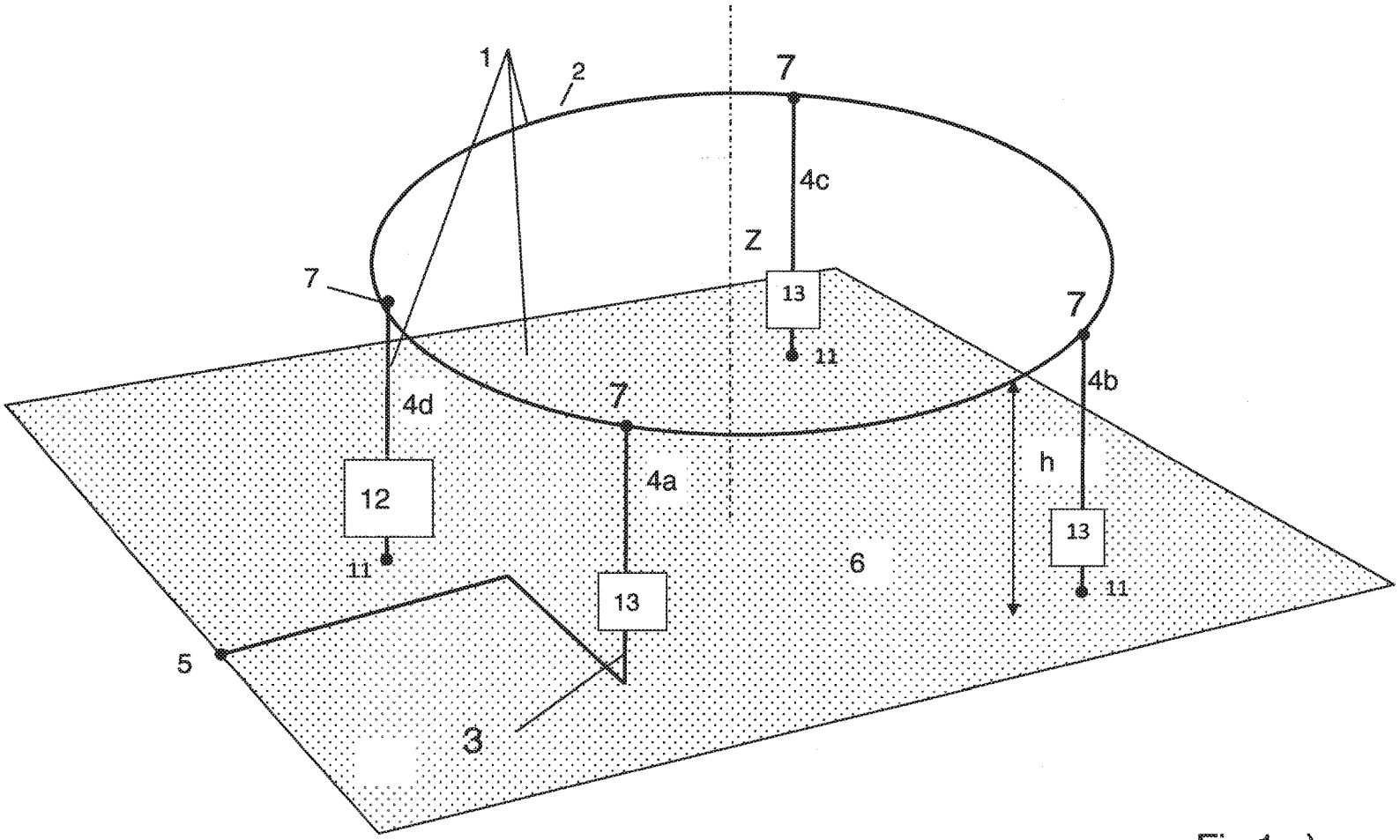
Figure 1:
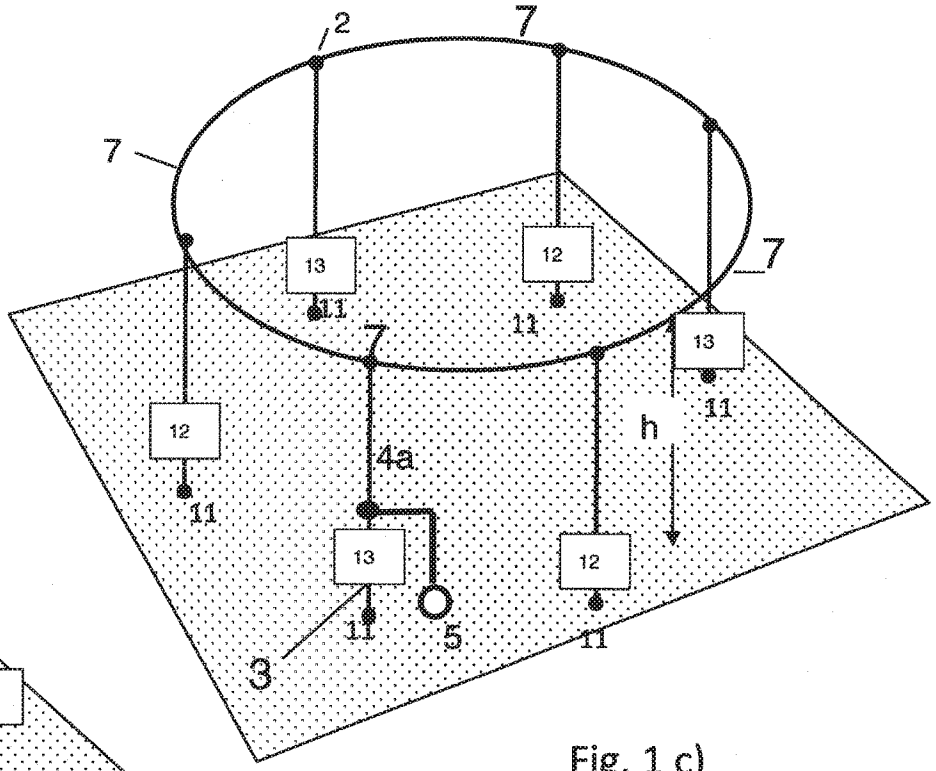
Figure 1:
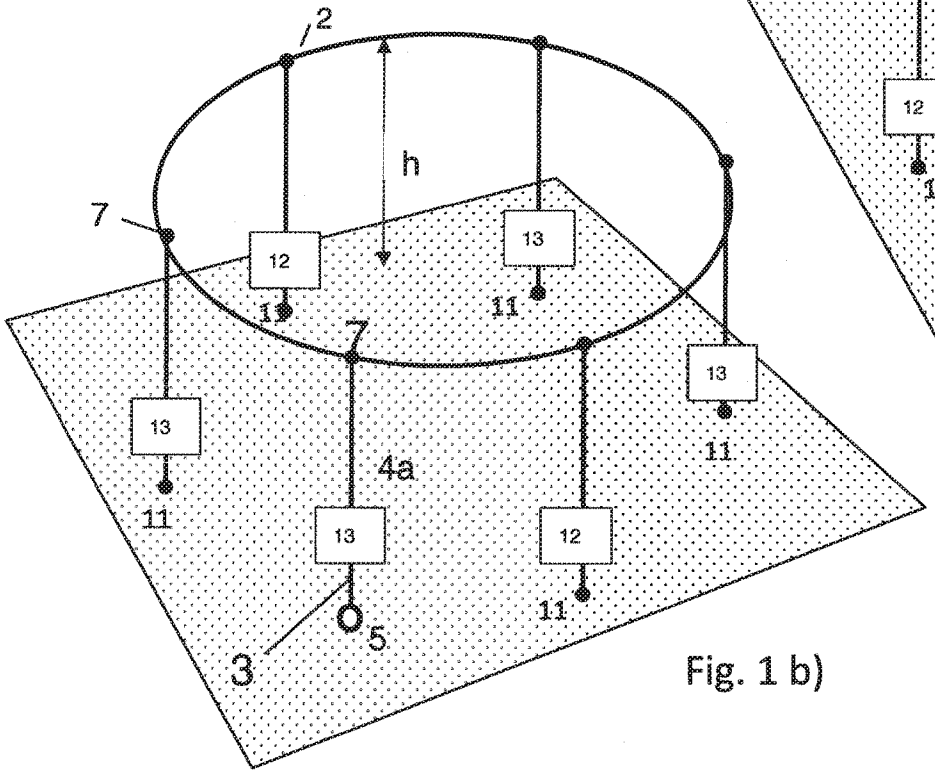

| | | | | |
|---|---|---|---|---|
| 2015/0123869 | A1 | 5/2015 | Bit-Babik et al. | |
| 2017/0047665 | A1* | 2/2017 | Yang | H01Q 19/005 |

FOREIGN PATENT DOCUMENTS

| | | | |
|---|---|---|---|
| EP | 2424036 | A2 | 2/2012 |
| GB | 1105354 | A | 3/1968 |
| NL | 6602498 | A | 8/1967 |

* cited by examiner

ANTENNA FOR THE RECEPTION OF CIRCULARLY POLARIZED SATELLITE RADIO SIGNALS FOR SATELLITE NAVIGATION ON A VEHICLE

The invention relates to an antenna arrangement for the reception of circularly polarized satellite radio signals, in particular for satellite radio navigation.

Satellite radio signals are as a rule transmitted using circularly polarized electromagnetic waves due to polarization rotations on the transmission path and are used in all known satellite navigation systems. Modern navigation systems provide for an evaluation of simultaneously received radio signals of a plurality of satellite navigation systems, in particular for global availability in conjunction with high navigation accuracy in mobile navigation. Such systems that receive in combination are collected together under the name GNSS (global navigation satellite system) and include known systems such as GPS (global positioning system), GLONASS, Galileo and Beidou, etc. Satellite antennas for navigation on vehicles are as a rule configured on the electrically conductive outer skin of the vehicle body. Circularly polarized satellite reception antennas are used such as are known from DE 10 2009 040 910 A or DE 40 08 505 A. In particular those antennas that are characterized by a low construction height in conjunction with a cost-effective manufacturing capability are suitable for configuration on vehicles. They in particular include the ring line radiator known from DE 10 2009 040 910 A, designed as a resonant structure, and having a small construction volume that is in particular an absolute requirement for mobile applications. The antenna has a small base surface and is very low with a height of less than one tenth of the free space wavelength.

Patch antennas that are, however, more complex and/or expensive in design than antennas stamped from sheet metal are known in accordance with the prior art as further antennas for satellite navigation on vehicles. One challenge for the satellite antennas for GNSS comprises the demand for a large frequency bandwidth that is, for example, predefined for GPS by the frequency band L1 having the center frequency 1575 MHz (required bandwidth approximately 80 Hz) and by the frequency band L2 having the center frequency 1227 MHz (required bandwidth approximately 53 MHz). This requirement is, for example, covered by a separate antenna associated with a respective one of the frequency bands L1 and L2 or by a broadband antenna comprising both frequency bands. Systems for the simultaneous evaluation of signal content in the frequency bands L1 and L2 make particularly high demands on the antennas, and indeed with a small available construction space such as is above all always present in vehicle construction. The use of separate antennas located in close proximity to one another for the two frequency bands includes the problem of mutual electromagnetic coupling with the effect of influencing the radiation patterns and the polarization purity and in particular the cross polarization. Due to the signals of the position location satellites incident at low angles of elevation and even with sufficient gain in the desired, typically right hand circular polarization direction (RHCP), the suppression of the opposite polarization direction—the cross polarization—acquires crucial importance with respect to correct position location results. The accuracy of the position location result is thus particularly influenced by the ratio of the desired polarization direction to the cross polarization of the satellite reception antenna, that is by the cross-polarization spacing. On the other hand, the implementation of a satellite navigation antenna which covers both frequency bands with a bandwidth of approximately 360 MHz and in so doing satisfies the in part very strict demands on the cross-polarization spacing is technically difficult.

In particular satellite reception antennas having a small construction space are suitable for use on vehicles. Antennas of this kind in accordance with the prior art are known as patch antennas. They are, however, less powerful with respect to the reception at a low angle of elevation and are more complex and/or expensive in design. This disadvantage is remedied in part by ring line antennas such as are described in DE 10 2009 040 910 A. It is desirable, even for such antennas, to improve the cross-polarization spacing over the full bandwidth of the above-described frequency bands L1, L2 or L5.

Satellite reception antennas for satellite navigation are provided for installation on horizontal surfaces of the electrically conductive vehicle body. The substantially horizontal vehicle roof acts as a conductive base surface with respect to the antenna properties.

It is the underlying object of the invention to provide an antenna for the reception of circularly polarized satellite radio signals for satellite navigation which has a high cross-polarization spacing over a frequency range which is as large as possible and which is thus suitable for the acquisition of particularly accurate position location results in a vehicle with sufficient gain and also at low angles of elevation of the radiation characteristics.

This object is satisfied by the features of claim 1.

The advantage is associated with an antenna in accordance with the invention that it can be manufactured particularly inexpensively and is thus particularly suitable for mass production and for use in the mass production of vehicles.

In accordance with the invention an antenna 1 for the reception of circularly polarized satellite radio signals comprises at least one horizontally oriented conductor loop arranged above a conductive base surface 6, comprising an arrangement connected to an antenna connector 5 for the electromagnetic excitation of the conductor loop. The conductor loop is formed by a polygonal or circular closed ring line in a horizontal plane having a height h and extending over the conductive base surface 6. The ring line radiator 2 forms a resonant structure and is electrically excitable by electromagnetic excitation in a manner such that the current distribution of a propagating line wave is adopted on the ring line in a single revolving direction whose phase difference over one revolution amounts to exactly $2\pi$.

Radiators 4, 4*a-d* that are galvanically coupled to the ring line radiator 2, that are vertical, and that extend toward the conductive base surface 6 are present at ring line coupling points 7 at the periphery of the ring line radiator 2, with the excitation of the conductive loop taking place via one of the radiators as the active radiator 4*a* and the other radiators are coupled as passive radiators 4*b*, 4*c*, 4*d* to the electrically conductive base surface 6.

At least two vertical passive radiations 4*b*, 4*c*, 4*d* are present which are galvanically coupled to the ring line radiator 2, which extend toward the conductive base surface 6 and of which N vertical radiators 40 are coupled to the electrically conductive base surface 6 over a reactance circuit having an active component 12 whose loss factor is greater than the value 0.1/N. At no point along the ring line radiator 2 are two of these N vertical radiators arranged adjacent to one another. All the remaining passive vertical radiators 4*b*, 4*c* are coupled to the base surface 6 via lossless reactance circuits 13. All the radiators are approximately evenly distributed along the ring line radiator 2 so that none of the spacings between mutually adjacent ring line coupling points 7 at the periphery of the ring line radiator 2 is smaller than half the spacing that would result with an equidistant distribution of all the radiators over the stretched length L of the ring line radiator (2).

Advantage embodiments will be explained in more detail in the following:

At least two of the part sections of the ring line radiator 2 that are respectively located between two adjacent ring line coupling points and that have mutually different wave impedances ZL1, ZL2 can be present.

The reactance circuit having the active component 12 for coupling N vertical radiators 4*d* to a ground connector 11 on the electrically conductive base surface 6 can be formed in each case by the serial connection of a capacitor 15 and a circuit having ohmic losses 12*a* and each of the remaining passive vertical radiators 4*b*, 4*c* can be provided with a lossless reactance circuit 13 realized as a capacitor 15 for coupling to a ground connector point 11 on the electrically conductive base surface 6.

The stretched length L of the ring line of the ring line radiator 2 in resonance can be shortened by the effect of the vertical radiators 4, starting from approximately the line wavelength λ down to approximately half the line wavelength λ.

The active vertical radiator 4*a* can be provided with a reactance circuit 13 implemented as a capacitor 15 for coupling to the antenna connector 5.

The circuit having ohmic losses 12*a* can be formed from an ohmic resistor 20.

A parallel oscillating circle—comprising a parallel capacitor 18 and a parallel inductor 17—having a resonant frequency in the vicinity of the frequency band center can be connected in parallel with the ohmic resistor 20 to expand the frequency bandwidth of the cross-polarization spacing.

A respective parallel oscillating circle—comprising a capacitor 18 and an inductor 17—can be connected in parallel with the ohmic resistor 20 and the lossless reactance circuits 13, to which the remaining passive vertical radiators 4*b*, 4*c* having the electrically conductive base surface 6 are coupled, can each be formed from the serial connection of a capacitor 15 and a parallel oscillating circle—comprising a parallel capacitor 18 and a parallel inductor 17—and the resonant frequency of the parallel oscillating circles can each be selected as approximately in proximity to the center of a predefined frequency band for expanding the frequency bandwidth of the cross-polarization spacing.

The parallel resonant circle in the lossless reactance circuit 13 and the parallel resonant circuit respectively connected in parallel with the ohmic resistor 20 can be coordinated in this manner such that a maximum of the cross-polarization spacing is adopted in the respective frequency band center of the two satellite navigation frequency bands L1 and L2.

N=1 vertical radiators 4*d* having a reactance circuit having the active component 12 for coupling to a ground connector 11 on the electrically conductive base surface 6 can be present and said ground connector can be arranged adjacent to the active vertical radiator 4*a*.

The ring line radiator 2 can be designed as a rectangle at whose corners a respective ring line coupling point 7 having a vertical radiator 4*a-d* galvanically connected there can be formed.

To support the unidirectionality of the wave propagation on the ring line radiator 2, a further part section of the ring line radiator 2 disposed opposite the first part section and having a wave impedance (ZL2) differing from the wave impedance (ZL1) of the remaining part sections of the ring line radiator 2 can be present.

The lossless reactance circuits 13 of the passive radiators implemented as capacitors 15 for coupling to the conductive base surface 6 or for coupling to the circuit having ohmic losses 12*a* coupled to the conductive base surface 6 and the capacitor 15 for coupling the active radiator 4*a* to the antenna connector 5 can be formed in a manner such that the vertical radiators 4, 4*a-d* are molded at their lower ends to form individually designed areal capacitor electrodes 32*a*, 32*b*, 32*c*, 32*d* and the capacitors 15 can be configured by interposition of a dielectric plate 33 between the areal capacitor electrodes 32*a*, 32*b*, 32*c*, 32*d* and the electrically conductive base surface 6 formed as an electrically conductively coated circuit board 35 for coupling the passive radiators 4*b*, 4*c* to the electrically conductive base surface 6.

An areal counter-electrode 34 insulated from this film can be configured for the capacitive coupling of the active vertical radiator 4*a* to the antenna connector 5 and for the capacitive coupling of a passive vertical radiator 4*d* adjacent to the active vertical radiator 4*a* to the circuit having ohmic losses 12*a* on the electrically conductive base surface 6.

The conductive structure, comprising the ring conductor 2 and the vertical radiators 4, 4*a-d* connected thereto, can be fixed by a dielectric support structure 36 such that the dielectric board 33 is implemented in the form of an air gap.

Figure 2:
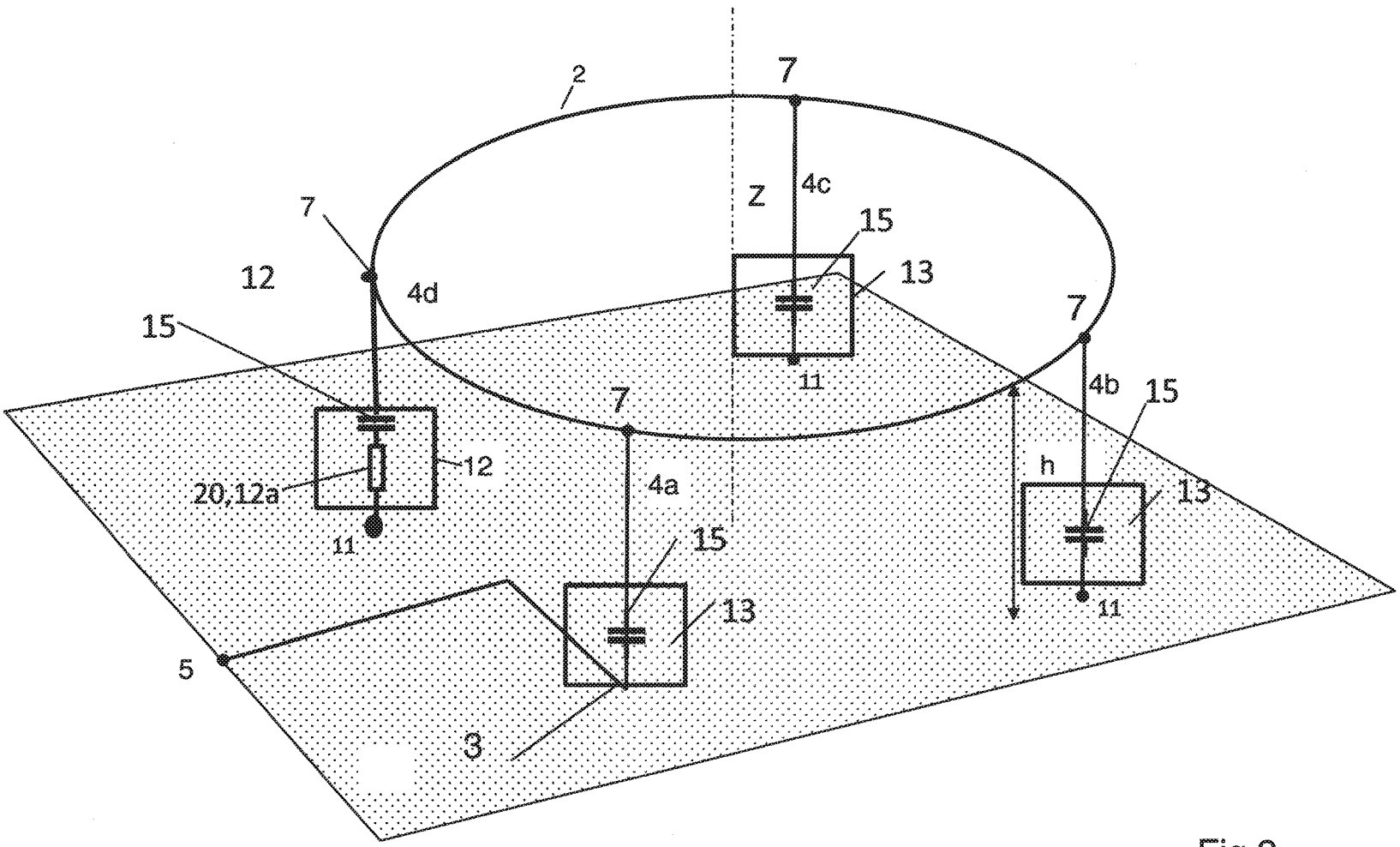
Figure 3:
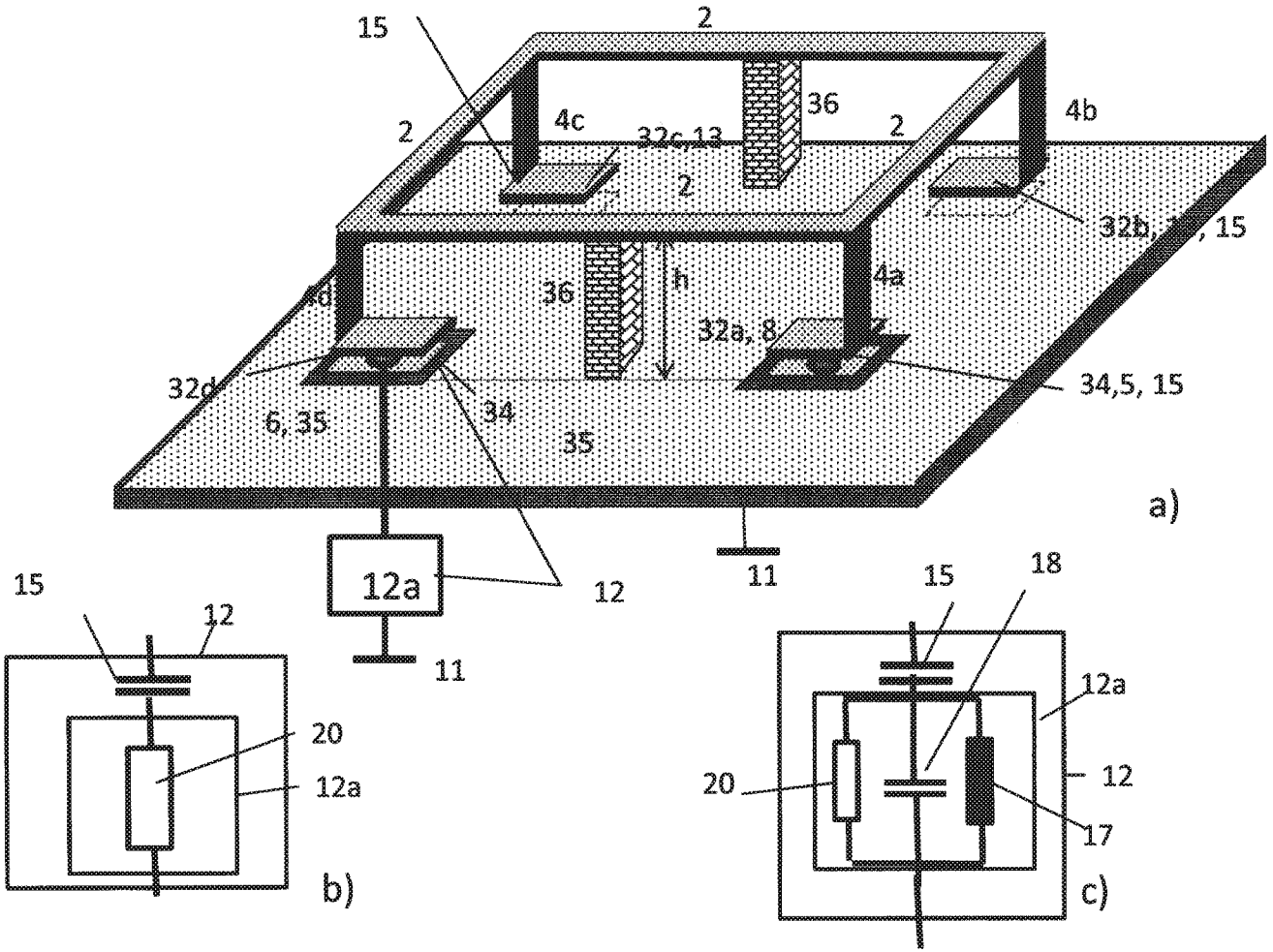
Figure 4:
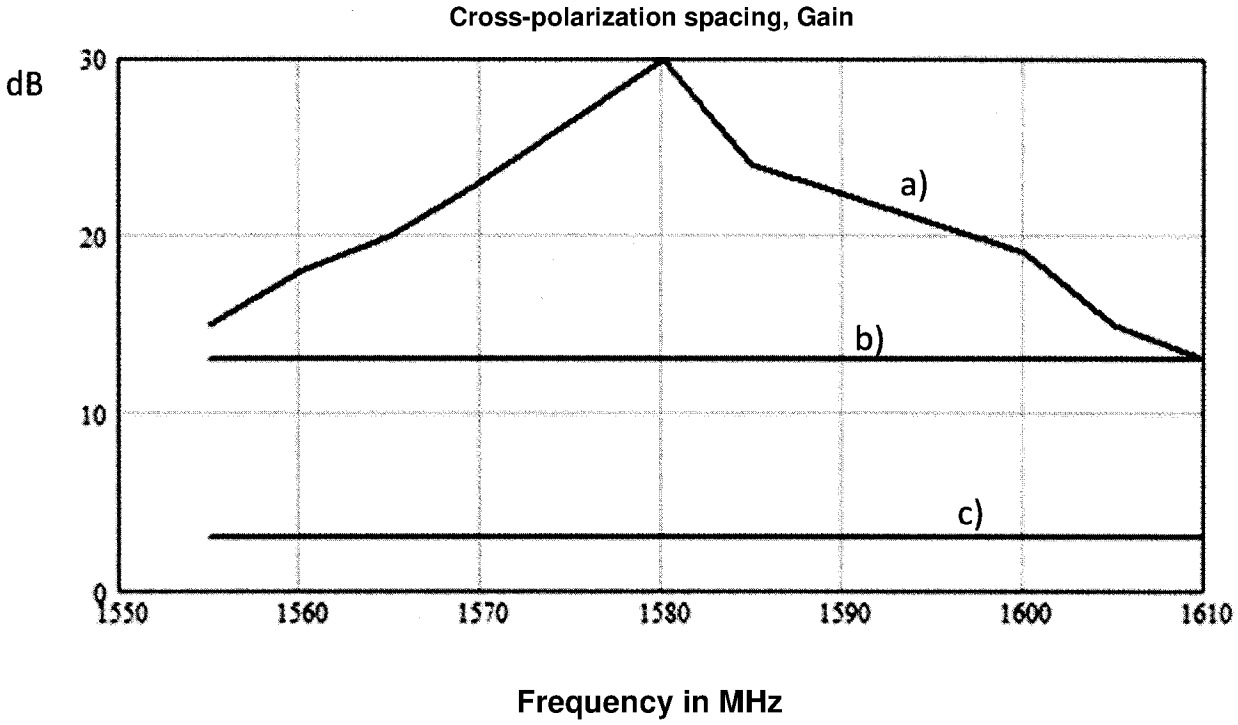
Figure 5:
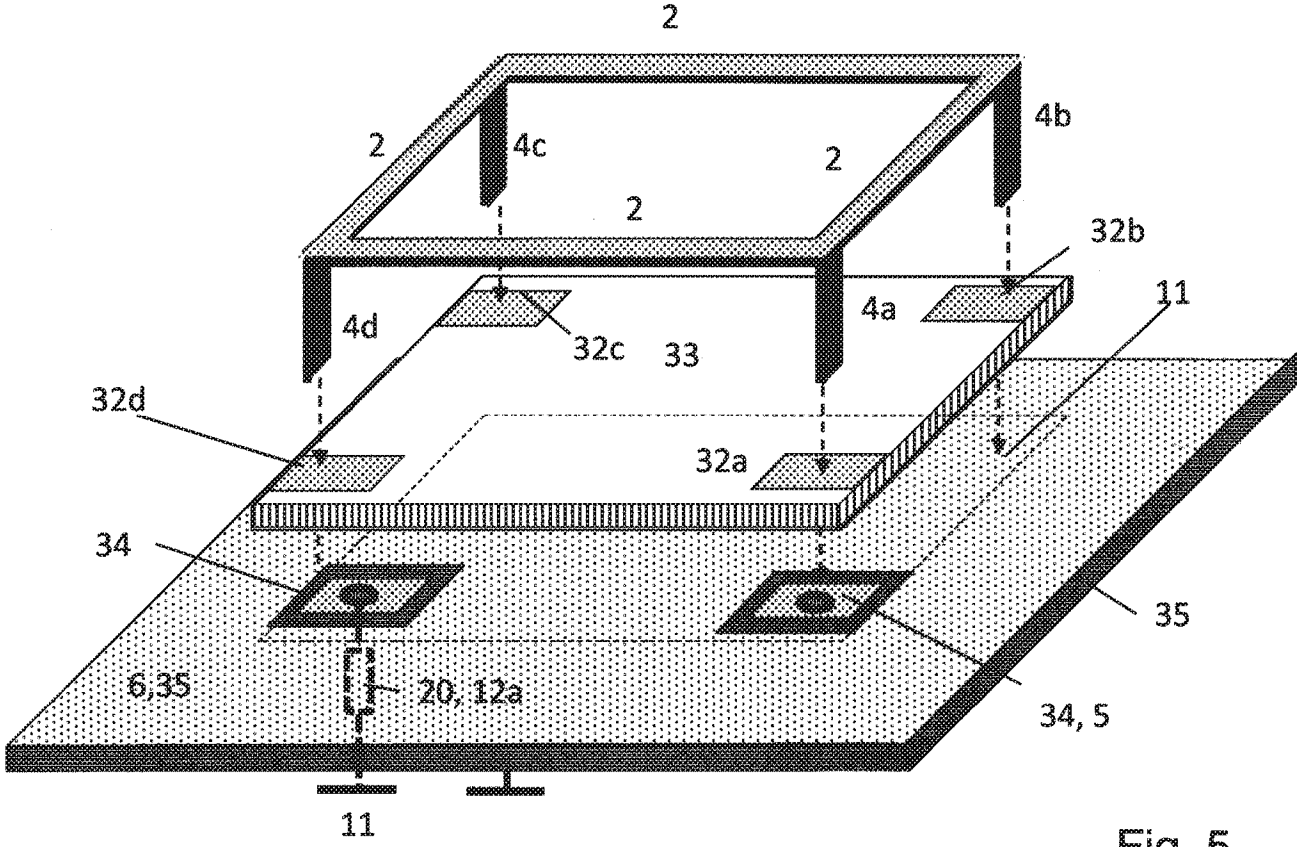
Figure 6:
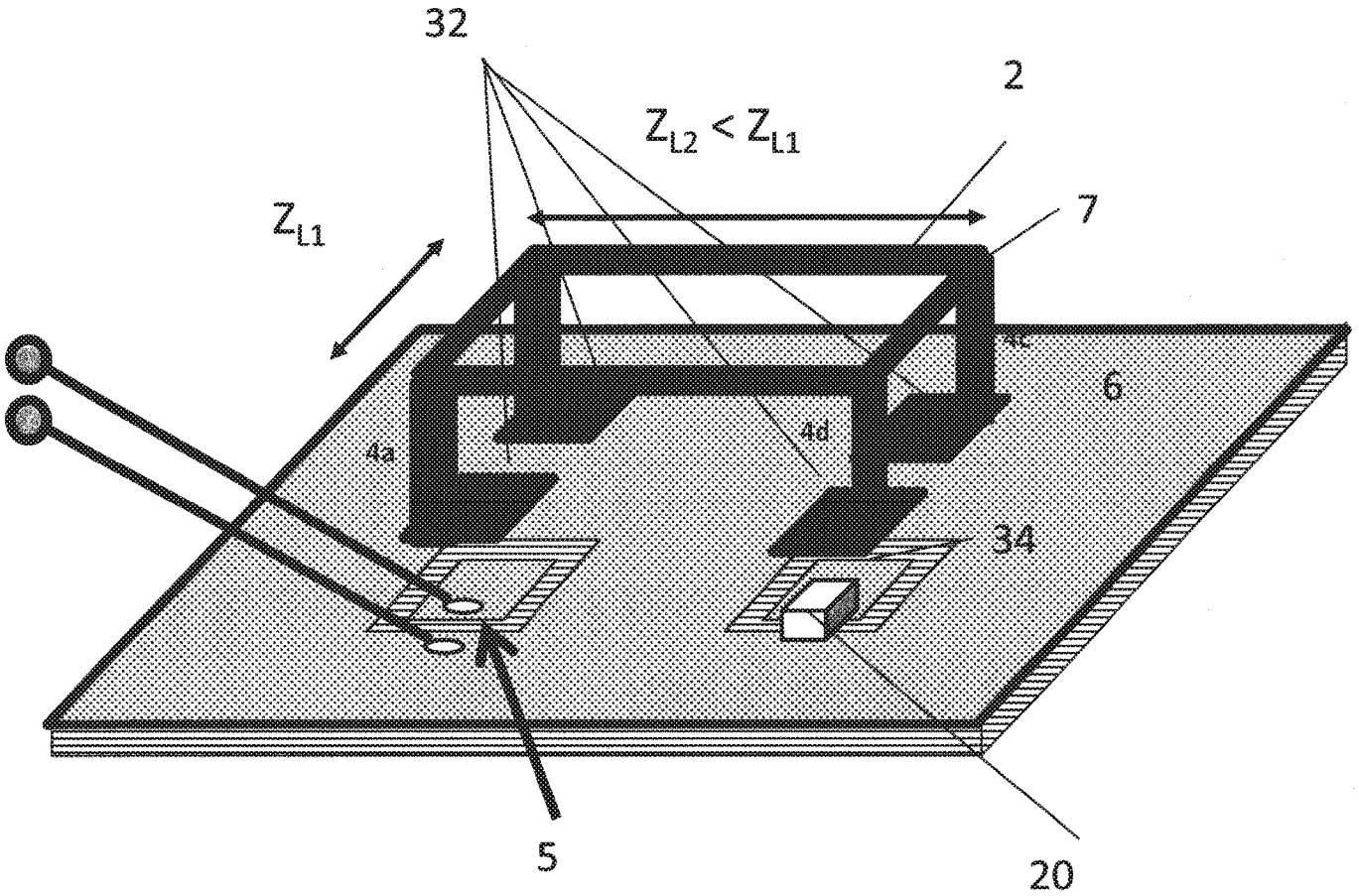
Figure 7:
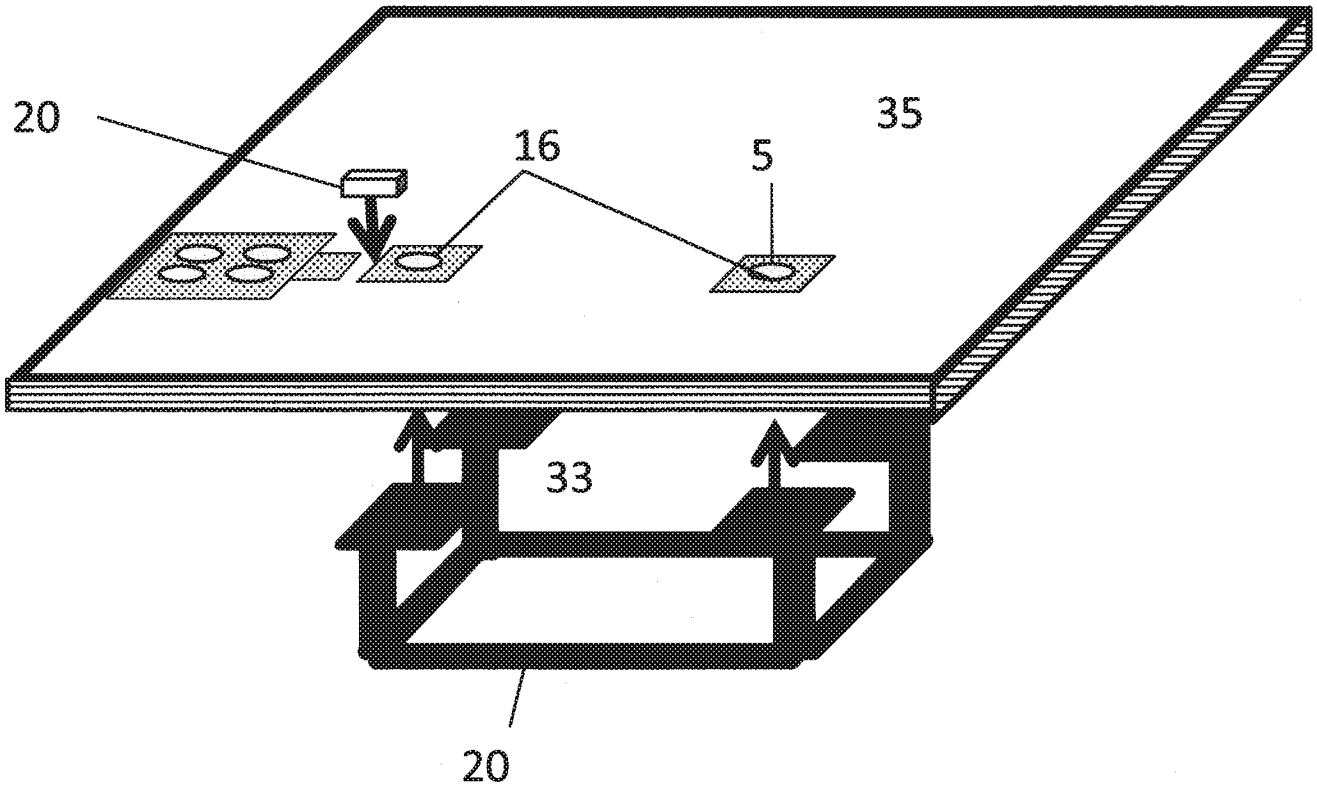

The associated Figures show in detail:

FIG. 1:

a)

an antenna in accordance with the invention having a ring line radiator 2 having vertical radiators 4*a*-4*d* galvanically coupled to ring line coupling points 7. The passive vertical radiator 4*d* which is arranged adjacent to the active vertical radiator 4*a* in the example shown is coupled via the ground connector point 11 to the conductive base surface 6 via the reactance circuit having an active component 12. The excitation of the ring line radiator 2 takes place via the active vertical radiator 4*a* that is connected to the antenna connector 5 via the lossless reactance circuit 13. The reactance circuits 13 and the reactance circuit having the active component 12 form the resonant structure together with the reactive properties of the ring line circuit 2 and of the vertical radiators 4 in a manner such that the current distribution of a propagating line wave is adopted on the ring line 2 in a single direction of revolution whose phase difference amounts to exactly 2π over one revolution;

b) an antenna in accordance with the invention as in Figure a), but with a changed arrangement of the vertical radiators at the periphery of the ring line radiator 2. Following a sense of revolution, a respective two vertical radiators interconnected with a lossless reactance circuit 13 are arranged between successive vertical radiators interconnected with a reactance circuit having an active component 12. The active radiator 4*a* is coupled to the antenna connector 5 via the lossless reactance circuit 13;

c) an antenna in accordance with the invention as in Figure b), but, following a sense of revolution, a respective only one vertical radiator interconnected with a lossless reactance circuit 13 is arranged between successive vertical radiators interconnected with a reactance circuit having an active component 12. The active radiator 4*a* is coupled both via the lossless reactance circuit 13 to the electrically conductive base surface 6 and to the antenna connector 5;

FIG. 2:

an antenna in accordance with the invention as in FIG. 1, with the reactance circuit having the active component 12 comprising as a simple serial connection a capacitor 15 and an ohmic resistor 20. The reactance circuit 13 that couples the active vertical radiator 4*a* to the antenna connector 5 is implemented by the capacitor 15. The resonance is given by a suitable selection of the capacitors 15. The resistor 20 is selected with respect to the maximization of the frequency bandwidth of the cross-polarization spacing. The reactance circuit 13 at the active radiator 4*a* is designed in a manner such that both the described resonance is given and the impedance of the antenna is adapted to the wave impedance of conventional antenna lines. The two remaining vertical passive radiators 4*b* and 4*c* are each connected via the reactance circuits 13 implemented as capacitors 15 to the ground connector point 11 having the conductive base surface 6;

FIG. 3:

a) an antenna in accordance with the invention as in FIGS. 1 and 2, but with a rectangularly shaped ring conductor 2. The capacitors 15 are formed in a manner such that the vertical radiators 4 are molded at their lower ends to form individually designed areal capacitor electrodes 32*a*, 32*b*, 32*c*, 32*d*. The capacitors 15 are designed for coupling two vertical radiators 4*b*, 4*c* to the electrically conductive base surface 6 by interposition between said areal capacitor electrodes and the dielectric board 33 and the electrically conductive base surface 6 configured as an electrically conductively coated circuit board. For the capacitive coupling of the active vertical radiator 4*d* to the antenna connector 5, the latter is designed as an areal counter-electrode 34 insulated from the conductive film. An areal counter-electrode 34 insulated from the conductive film is equally configured for coupling the radiator 4*d* adjacent to the active vertical radiator 4*a* to the circuit having ohmic losses 12*a*. The reactance circuit having the active component 12 is thus formed as a serial connection of the capacitor 15 and of the circuit having ohmic losses 12*a*. The dielectric board 33 is formed by an air gap in the Figure;

b) a circuit diagram of the reactance circuit having the active component 12 comprising the serial connection of the capacitor 15 and the circuit having ohmic losses 12*a* implemented by the ohmic resistor 20;

c) a circuit diagram of the reactance circuit having the active component 12 as in Figure b), but with a parallel resonant circuit, comprising the parallel capacitor 18 and the parallel inductor 17 in parallel connection with the resistor 20;

FIG. 4:

the course of the cross-polarization spacing and of the gain for the low incidence of the satellite signals at an angle of elevation of 20°, entered over the frequency in the satellite navigation frequency band L1;

a) implemented, extremely high cross-polarization spacing in dB;

b) an exemplary sufficient cross-polarization spacing in dB;

c) implemented antenna gain in dB;

FIG. 5:

a self-explanatory exploded diagram to explain the design of the antenna in accordance with the invention described in FIG. 3. The rectangular ring conductor 2 having vertical radiators 4 can be inexpensively manufactured as a stamped and bent part;

FIG. 6:

an antenna in accordance with the invention similar to in FIG. 3. A representation of the different wave impedances Z1 and ZL2 of the parts of the rectangular ring conductor 2 for supporting the unidirectionality of the sense of revolution of the electromagnetic current wave revolving at resonance. The ohmic resistor 20 is indicated as an SMD component as a bridge between the counter-electrode 34 and the conductive base surface 6. The impedance at the antenna connector 5 amounts to 50 ohms. Typical dimensions of a ring line antenna 2 for the frequency range L1 are 34*42 mm for width and length; h=8 mm; and ohmic resistance 20, R=130 ohms. The loss factor of the reactance circuit having the active component 12 amounts to 0.5. The capacity 15 amounts to approximately 0.3 pF (capacitor electrode 32 with respect to electrically conductive base surface 6 or counter-electrode 34);

FIG. 7:

an antenna in accordance with the invention as in FIG. 6, for example for the frequency band L1 with a view of the rear side of the circuit board 35. Two vias 16 of the circuit board 35 are used for this purpose. One of the two vias 16 in the example is connected via the ohmic resistor 20 of 130 ohms to the electrically conductive base surface 6; the other via 16 is connected to the antenna connector 5;

FIG. 8:

in the Figure, the upper side of the circuit board 35 of an antenna 1 in accordance with the invention is shown onto which the electrical ring line radiator 2 has been placed. For the configuration of a dual band capable multiband antenna in accordance with the invention—for example for the frequency ranges L1 and L2—the resonance circuit 13 is respectively designed in a multifrequency manner such that both the resonance of the ring line radiator 2 and the required direction of propagation of the line wave on the ring line radiator 2 is given in the mutually separate frequency bands L1 and L2.

Figure 8:
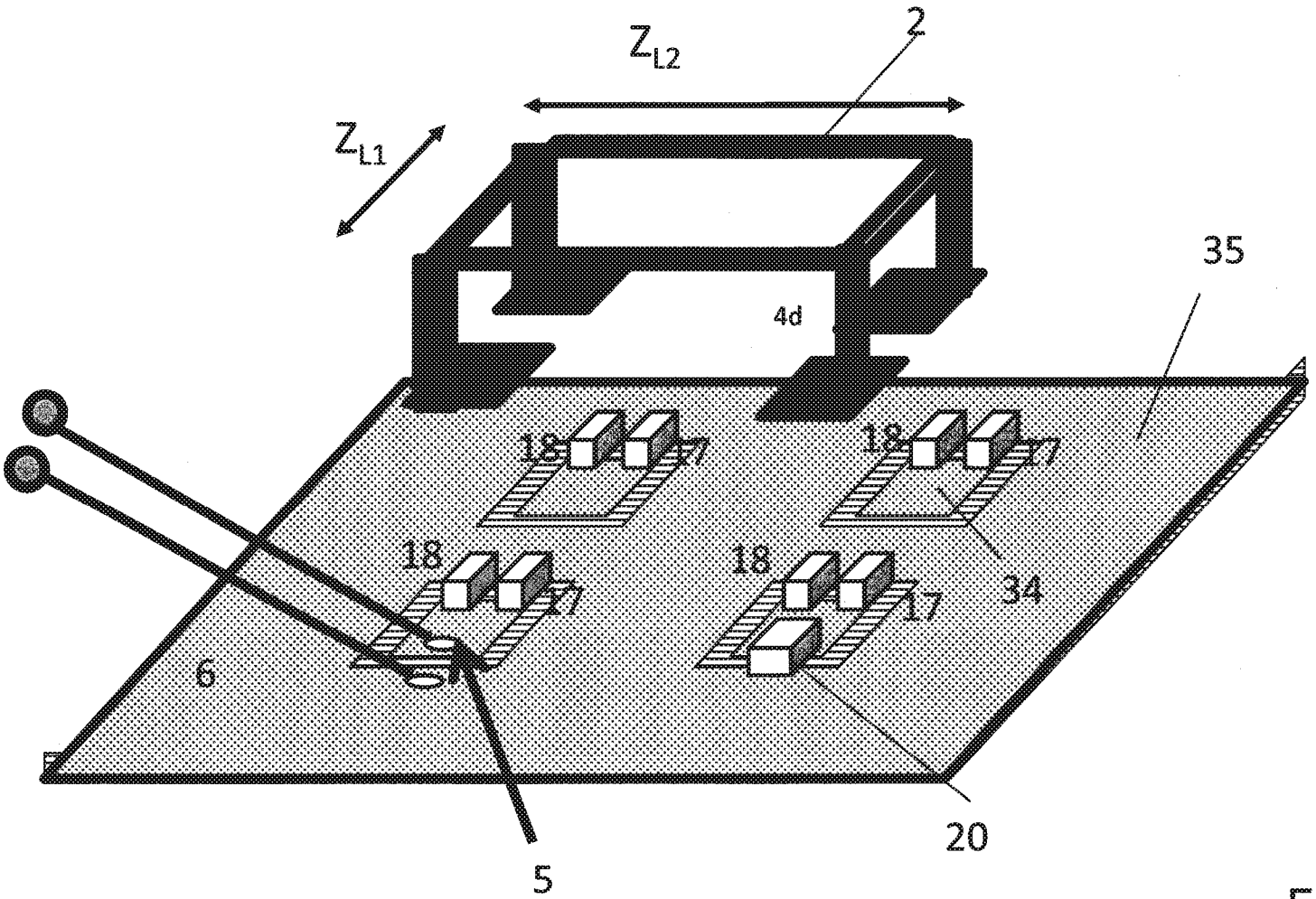
Figure 9:
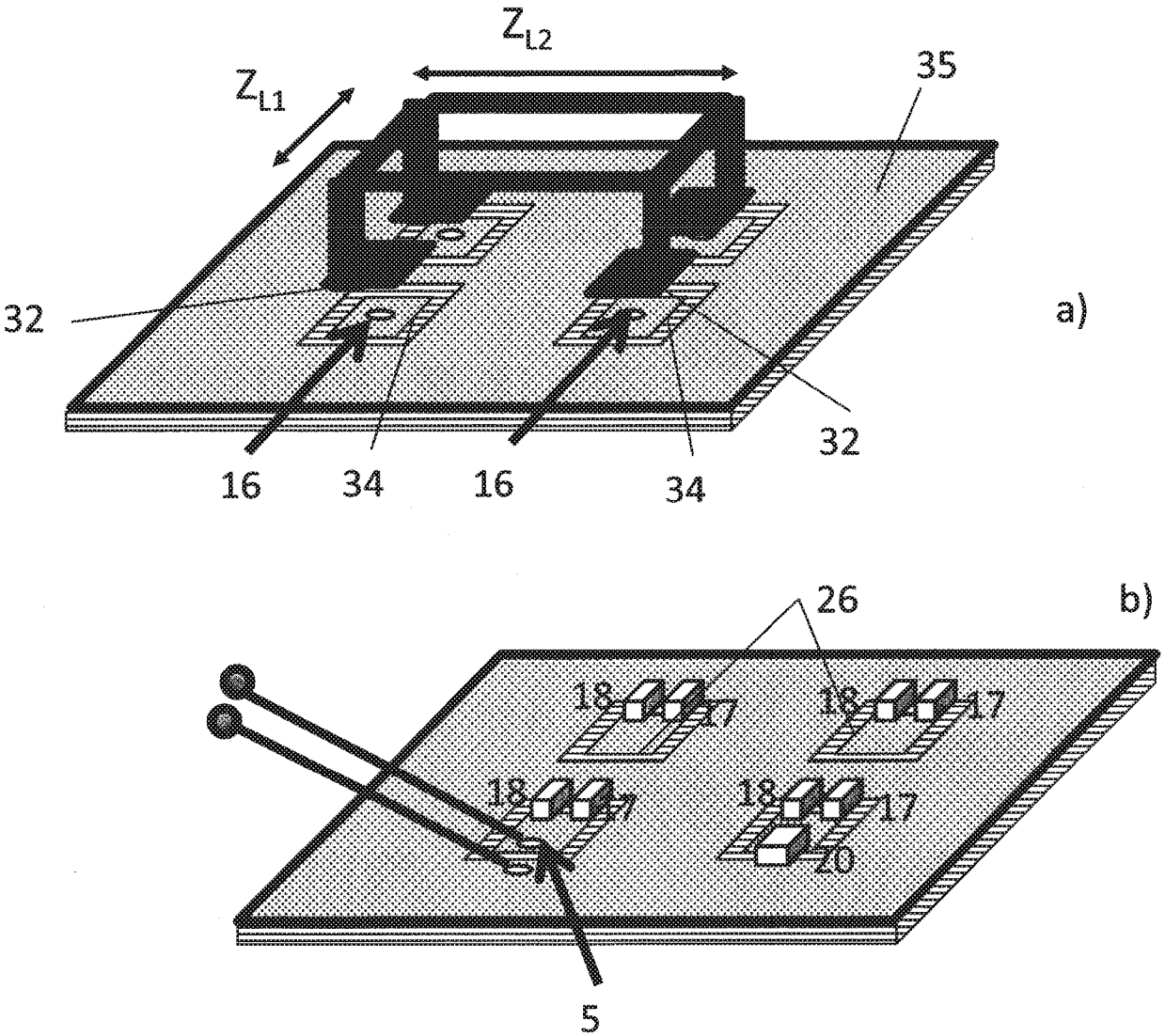

This is achieved in the example in FIG. 8 in that a respective counter-electrode 34 is present for all the capacitor electrodes 32 and in that a parallel circuit of parallel capacitor 18 and a parallel inductor 17—shown as SMD components—is connected in series to the capacitor 15 effected by the capacitor electrodes 32 at all the vertical radiators 4 between the counter-electrode 34 and the electrically conductive base surface 6. The ohmic resistor 20 in the radiator 4*d* is approximately dimensioned for the frequency center between the two frequency bands L1 and L2 with respect to an optimum cross-modulation spacing in the two frequency bands; and

FIG. 9:

a dual band antenna in accordance with the invention as in FIG. 8;

a) with a view of the upper side of the circuit board 35 having vias 16 on the counter-electrode 34 beneath the capacitor electrodes 32;

b) all the SMD circuit elements are correspondingly arranged on the rear side of the circuit board on pads 26 that are connected via vias 16.

The mode of operation of the suppression of the unwanted polarization direction LHCP of an antenna provided for RHCP can be compared to that of a bridge circuit or to a hybrid ring. Such a bridge can, however, only be completely compared for a specific frequency—generally approximately the center frequency of a frequency band. With frequencies differing therefrom, in addition to the wanted radiation in the RHCP mode, the unwanted radiation naturally arises in the opposite direction of rotation, that is the LHCP mode, on excitation at a gate, that is at the active vertical radiator 4*a* in FIG. 1*a*.

The interconnection of the radiator 4*d* adjacent to the excited radiator 4*a* and having a reactance circuit having the active component 12 influences the phasing of the voltage at this radiator in a manner such that the unwanted LHCP portion in the radiation is also largely compensated with a frequency offset from the center frequency. It is found in accordance with the invention in this respect that a substantially greater bandwidth of the required cross-polarization spacing can already be achieved with a simple combination of a serial connection of a capacitor 15 having an ohmic resistor 20, as shown in FIGS. 2 and 3*b*. The slight loss of antenna gain caused by the active component of the reactance circuit having the active component 12 is practically without any influence on the location position result. The bandwidth of the cross-modulation spacing is decisive for this with a sufficient antenna gain. It is generally known that antenna properties can be designed with greater bandwidth by damping with lossy elements. The aim is, however, associated with the present invention that the bandwidth of the cross-modulation spacing is greatly raised by the measures in accordance with the invention, but the attenuation of the antenna gain caused by the active components is sufficiently low. This selective effect on the bandwidth of the cross-modulation spacing in accordance with the invention is achieved in a particular manner in that in particular those modes of the current on the ring line radiator 2 are suppressed which cause the radiation in the unwanted polarization direction LHCP. These modes are in particular generated by a selection of different wave impedances of the part sections of the ring line radiator 2 in combination with the alternating order at the ring line radiator periphery of vertical radiators 4 having a reactance circuit having an active component 12 and those vertical radiators 4 that are each interconnected with a lossless reactance circuit 13. The wave impedance of such a part section is given by its distributed capacitance to the conductive base surface 6 and its distributed longitudinal inductance.

The low-effort implementation of a reactance circuit having an active component 12 is advantageous in this respect. A particular advantage of the invention also comprises the improvement of the bandwidth of the cross-modulation spacing already being able to be achieved with only N=1, that is with only one single vertical radiator having a reactance circuit having an active component 12—whose loss factors is greater than 0.2. The ratio of the effective resistance/reactance with a serial specification or of the conductance/susceptance with a parallel specification of the reactance circuit is designated as the loss factor of the reactance circuit having the active component 12—analogously to the customary definition.

Provision is made in accordance with the invention, as described above, with N>1, to arrange a plurality of vertical radiators interconnected with the reactance circuit having the active component 12 along the periphery of the ring line radiator 2. Provision is made in accordance with the invention in this case to select the loss factor in accordance with the number N of each of the reactance circuits having the active component 12 as no smaller than 0.2/N.

The bandwidth of the cross-modulation spacing can be further increased by using more complicated circuits. The parallel connection of a parallel resonant circuit, comprising the parallel inductor 17 and the parallel capacitor 18, to the ohmic resistor 20 in FIG. 3*c* promotes the frequency bandwidth of the demanded cross-polarization spacing in the frequency environment of the resonant frequency of the parallel resonant circuit. With such circuits such as have already been described above for the maximization of the frequency bandwidth of the cross-polarization spacing respectively in the frequency band center of the two satellite navigation frequency bands L1 and L2, losses in the resonant circuits 13 desired to be lossless cannot be completely avoided due to the limited quality (C and L) of the available blind elements. It has, however, been found that the increase of the bandwidth of the cross-polarization spacing intended by the invention can already be detected when, with a number of likewise N radiators having reactance circuits 13, their loss factors are not larger than approximately ⅕ of the loss factor in the reactance circuits having the active component 12.

REFERENCE NUMERAL LIST

Antenna 1
Ring line radiator 2
Electromagnetic excitation 3
Vertical radiators 4, 4*a*, 4*b*, 4*c*, 4*d*
Active vertical radiator 4*a*
Passive vertical radiator 4*d*
Antenna connector 5
Conductive base surface 6
Ring line coupling points 7, 7*a*, 7*b*, 7*c*, 7*d*
Spacing of the height h 9
Ground connector point 11
Reactance circuit having an active component 12
Circuit having ohmic losses 12*a*
Lossless reactance circuit 13
Capacitor 15
Via 16
Inductor 17
Parallel capacitor 18
Ohmic resistor 20
Pad 26
Capacitor electrode 32*a*, 32*b*, 32*c*, 32*d*
Dielectric board 33
Counter-electrode 34
Circuit board 35
Support structure 36
Spacing 37
Wave impedance ZL, ZL1, ZL2
Stretched length of the ring line radiator L

The invention claimed is:

1. An antenna for the reception of circularly polarized satellite radio signals, wherein the antenna comprises at least one horizontally oriented conductor loop arranged over a conductive base surface, comprising:

an arrangement connected to an antenna connector for electromagnetic excitation of the at least one horizontally oriented conductor loop, wherein the at least one horizontally oriented conductor loop is formed as a ring line radiator by a polygonal or circular closed ring line in a horizontal plane having a height and extending over the conductive base surface;

wherein the ring line radiator forms a resonant structure and is electrically excitable by the electromagnetic excitation in a manner such that a current distribution of a propagating line wave is adopted on a ring line in a single revolving direction whose phase difference over one revolution amounts to 2π;

wherein radiators that are galvanically coupled to the ring line radiator, that are vertical, and that extend toward the conductive base surface are present at ring line coupling points at a periphery of the ring line radiator, with one of the radiators being configured as an active radiator via which the electromagnetic excitation of the at least one horizontally oriented conductor loop takes place and the other radiators being coupled as vertical passive radiators to the conductive base surface;

wherein at least two vertically passive radiators are present which are galvanically coupled to the ring line radiator and extend toward the conductive base surface and of which N vertical passive radiators are coupled via a reactance circuit having an active component to the conductive base surface, with a loss factor of the active component respectively being larger than a value 0.1/N, wherein N is an integer greater than or equal to 1;

wherein two of the vertical passive radiators are not arranged adjacent to one another at any point along the ring line radiator;

wherein all the remaining vertical passive radiators are coupled via lossless reactance circuits to the conductive base surface; and wherein no spacings between mutually adjacent ring line coupling points are smaller at the periphery of the ring line radiator than half the spacing that would result with an equidistant distribution of all the radiators over a stretched length of the ring line radiator.

2. An antenna in accordance with claim 1, wherein at least two part sections of the ring line radiator are present and are respectively located between two adjacent ring line coupling points and have mutually differing wave impedances.

3. An antenna in accordance with claim 1, wherein the reactance circuit having the active component for coupling the N vertical passive radiators to a ground connector on the conductive base surface is respectively formed by a serial connection of a capacitor and a circuit having ohmic losses;

and each of the remaining vertical passive radiators is provided with a lossless reactance circuit implemented as a capacitor for coupling to a ground connector point on the conductive base surface.

4. An antenna in accordance with claim 1, wherein the stretched length of the ring line of the ring line radiator in resonance is shortened by an effect of the vertical radiators, starting from approximately a line wavelength down to approximately half the line wavelength.

5. An antenna in accordance with claim 1, wherein the active radiator is provided with a reactance circuit implemented as a capacitor for coupling to the antenna connector.

6. An antenna in accordance with claim 1, wherein the active radiator is coupled both by the antenna connector and via a lossless reactance circuit implemented as a capacitor to ground.

7. An antenna in accordance with claim 1, wherein the reactance circuit having ohmic losses is formed from an ohmic resistor.

8. An antenna in accordance with claim 7, wherein a parallel oscillating circle having a resonant frequency in a vicinity of a frequency band center is connected in parallel with the ohmic resistor to expand a frequency bandwidth of cross-polarization spacing, with the parallel oscillating circle comprising a parallel capacitor and a parallel inductor.

9. An antenna in accordance with claim 7, wherein a respective first parallel oscillating circle is connected in parallel with the ohmic resistor; wherein the first parallel oscillating circle comprises a capacitor and an inductor and the lossless reactance circuits to which the remaining vertical passive radiators having the conductive base surface are coupled are respectively formed from a serial connection of a capacitor and a second parallel oscillating circle; and wherein the second parallel oscillating circle comprises a parallel capacitor and a parallel inductor and a resonant frequency of the parallel oscillating circles are respectively selected approximately in proximity of the center of a predefined frequency band to expand a frequency bandwidth of cross-polarization spacing.

10. An antenna in accordance with claim 9, wherein, a respective parallel resonant circuit in the lossless reactance circuit and a parallel resonant circuit connected in parallel with the ohmic resistor in a manner such that a maximum of the cross-polarization spacing is respectively set in a frequency band center of two satellite navigation frequency bands.

11. An antenna in accordance with claim 1, wherein a vertical passive radiator having a reactance circuit having an active component is present for coupling to a ground connector on the conductive base surface and the ground connector is arranged adjacent to the active radiator.

12. An antenna in accordance with claim 1, wherein the ring line radiator is designed as a rectangle at whose corners a respective ring line coupling point having a vertical radiator galvanically connected there is formed.

13. An antenna in accordance with claim 12, wherein to support unidirectionality of the wave propagation on the ring line radiator, a further part section of the ring line radiator disposed opposite the first part section and having a wave impedance differing from the wave impedance differing from the wave impedance of the remaining part sections of the ring line radiator is present.

14. An antenna in accordance with claim 1, wherein the reactance circuits of the vertical passive radiators implemented as capacitors for coupling to the conductive base surface or for coupling to the reactance circuit having ohmic losses coupled to the conductive base surface and the capacitor for coupling the active radiator to the antenna connector are formed in a manner such that the vertical radiators are molded at their lower ends to form individually designed areal capacitor electrodes; wherein the capacitors are designed for coupling the vertical passive radiators to the conductive surface by interposition of a dielectric board between the areal capacitor electrodes and the conductive base surface designed as an electrically conductive base surface; and wherein an areal counter-electrode insulated from this film is configured for capacitive coupling of the active radiator to the antenna connector and for capacitive coupling of a passive vertical radiator adjacent to the active radiator to the reactance circuit having ohmic losses on the electrically conductive base surface.

15. An antenna in accordance with claim 14, wherein a structure comprising the ring line radiator and the vertical radiators connected thereto is fixed by a dielectric support structure such that the dielectric board is implemented as an air gap.

* * * * *